United States Patent [19]

Ando

[11] 4,410,849

[45] Oct. 18, 1983

[54] ELECTRIC DUST COLLECTING APPARATUS HAVING CONTROLLED INTERMITTENT HIGH VOLTAGE SUPPLY

[75] Inventor: Takashi Ando, Kobe, Japan

[73] Assignee: Mitsubishi Jukogyo Kabushiki Kaisha, Tokyo, Japan

[21] Appl. No.: 246,319

[22] Filed: Mar. 23, 1981

[51] Int. Cl.[3] ..... B03C 3/68

[52] U.S. Cl. ..... 323/237; 55/105; 323/903; 363/86

[58] Field of Search ..... 323/237, 903, 241; 363/86; 361/235; 55/105

[56] References Cited

U.S. PATENT DOCUMENTS

| | | | |
|---|---|---|---|
| 3,443,361 | 5/1969 | Drenning | 323/903 |
| 3,648,437 | 3/1972 | Bridges | 323/903 |
| 4,138,233 | 2/1979 | Masuda | 361/235 |
| 4,322,786 | 3/1982 | Weber | 361/235 |

*Primary Examiner*—William H. Beha, Jr.
*Attorney, Agent, or Firm*—Wenderoth, Lind & Ponack

[57] ABSTRACT

In an electric dust collecting apparatus of the type that a dust collecting effect is achieved by applying a high D.C. voltage between dust collecting electrodes, wherein the high voltage is controlled via a typical power control device including thyristors, there is provided an additional control circuit for intermittently controlling the power control device to generate an intermittent high voltage output in such a manner that both the repetition rate and the pulse width of the D.C. high voltage output may be adjusted either manually or automatically so as to improve the dust collecting efficiency of the apparatus and to reduce the power consumption thereof.

3 Claims, 10 Drawing Figures

FIG. 3.
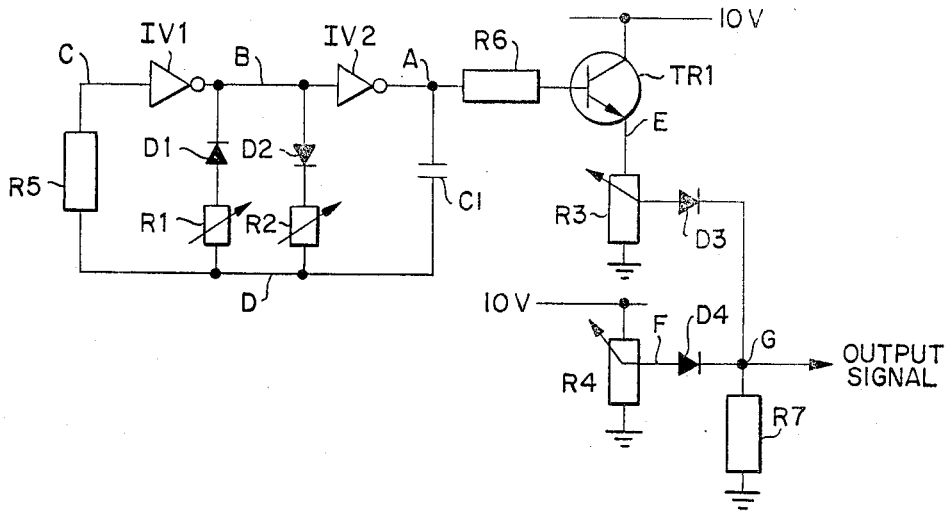
FIG. 4.
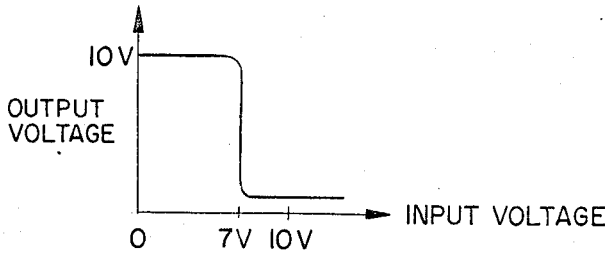
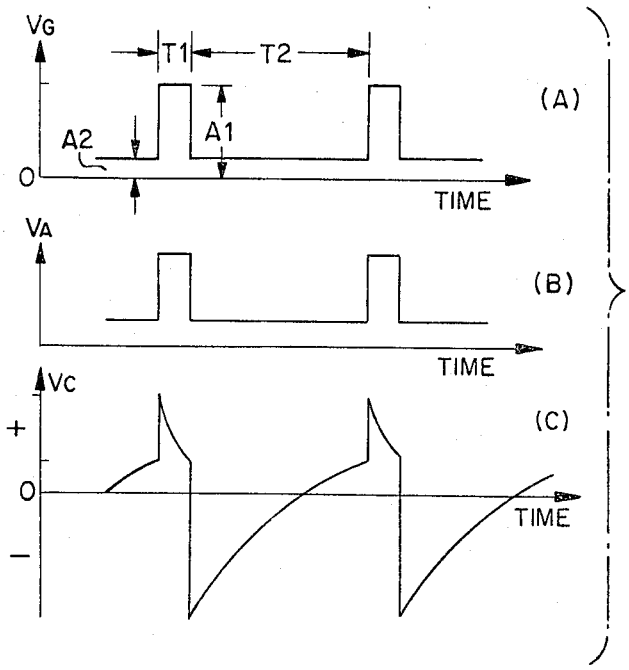
FIG. 5.

ELECTRIC DUST COLLECTING APPARATUS HAVING CONTROLLED INTERMITTENT HIGH VOLTAGE SUPPLY

BACKGROUND OF THE INVENTION

The present invention relates to an improvement in an electric dust collecting apparatus.

A typical prior art electric dust collector apparatus is illustrated in FIG. 1. In such an apparatus, a low voltage power supply 6 which may merely consist of a commercial A.C. power source provides a relatively low A.C. voltage to back-to-back thyristors 2. The thyristors 2 are controlled by the thyristor control circuit 7 so as to provide a controlled output to reactor 8 which feeds a high voltage transformer 9. The output of the high voltage transformer 9 is rectified by rectifier circuit 10 and the output of the rectifier circuit 10 is supplied to the dust collecting electrodes.

The thyristor control circuit 7 can be operated in either an automatic mode or a manual mode depending on the position of the selector switch 14. In the automatic mode, a spark detection circuit 12 controls a spark frequency control circuit 13 to provide an output to the phase angle circuit 16 which in turn drives the phase control 17. In this manner, the thyristors 2 are automatically controlled so as to vary the D.C. high voltage applied to the dust collecting electrodes 11.

When the selector 14 is in the manual position, a manual operation knob 15 is used to provide the control signal to the phase angle circuit 16. In this fashion, the high D.C. voltage output applied to the dust collecting electrodes 11 may be manually controlled.

However, in such a prior art type of electric dust collector, since dust particles which can be collected are limited, in principle, to those having a specific resistance within the scope of about $10^4$ to $10^{11}\Omega$cm, there is a shortcoming in that the dust collecting performance is greatly degraded for dust particles having a specific resistance within the scope of $10^{11}$ to $10^{13}\Omega$cm.

Such a degradation of the dust collecting performance of the known electric dust collector is caused by the occurrence of back corona within the dust collector. As a result of an extensive research over many years, the inventor of this invention has confirmed that the occurrence of the back corona phenomena is always associated with a time constant in the range of about 1 second, and hence has invented a novel electric dust collector whose dust collecting apparatus performance would be not degraded or less degraded even for dust particles having a specific resistance within the scope of $10^{11}$ to $10^{13}\Omega$cm, by making use of this characteristic time constant property of the back corona phenomena. The apparatus of the present invention operates by applying a current intermittently instead of applying a current continuously as is the case with the prior art, so that the current may be interrupted before the occurrence of the back corona phenomena.

SUMMARY OF THE INVENTION

It is therefore one object of the present invention to provide a novel dust collecting apparatus which can collect even the dust particles having a specific resistance within the scope of $10^{11}$ to $10^{13}\Omega$cm without degrading or with less degrading of its dust collecting performance.

According to one feature of the present invention, there is provided an electric dust collecting apparatus, in which a dust collecting effect is achieved by applying an intermittent high D.C. voltage between dust collecting electrodes. The high voltage is controlled by a power control device provided with a control circuit for intermittently controlling the output voltage in such a manner that the D.C. high voltage is applied, for example, during a first period of from approximately 0.001 to 1 second and is then interrupted during a subsequent period of from approximately 0.01 to 1 second.

BRIEF DESCRIPTION OF THE DRAWINGS

The above-mentioned and other features and objects of the present invention will become more apparent by reference to the following detailed description of the invention taken in conjunction with the accompanying drawings, wherein:

FIG. 3 is a more detailed circuit diagram of the intermittent control circuit included in the circuit arrangement in FIG. 2;

FIG. 4 is an input-output characteristic diagram of the inverter included in FIG. 3;

FIGS. 5(A), 5(B) and 5(C) are waveform diagrams representing waveforms at points A, B and C, respectively, in FIG. 3;

DESCRIPTION OF THE PREFERRED EMBODIMENT

Figure 2:
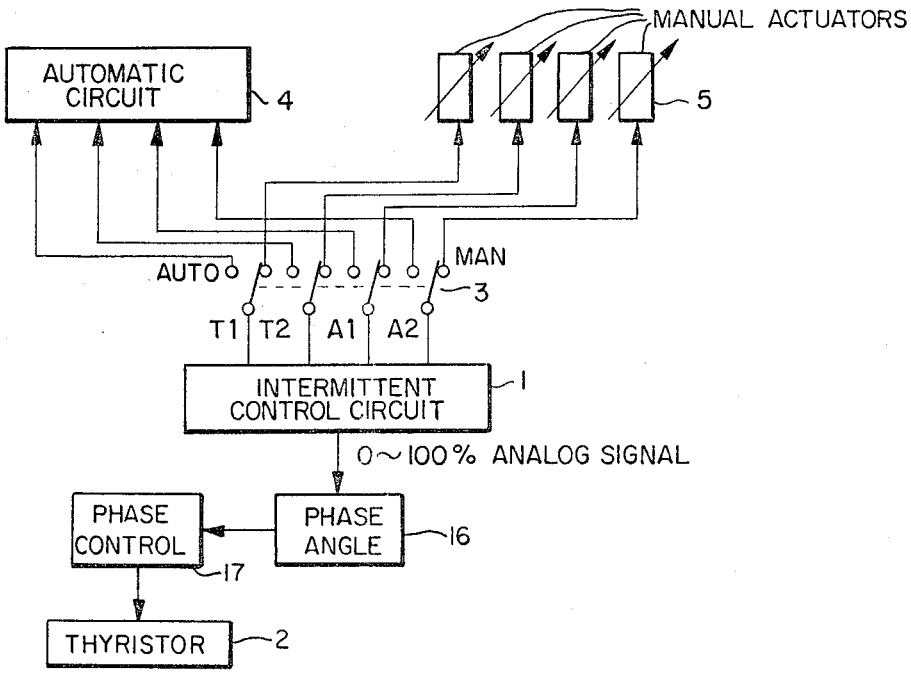
FIG. 2 is a schematic block diagram of a control circuit according to one preferred embodiment of the present invention.

Referring now to FIGS. 2 and 3 of the drawings, reference numeral 1 designates an intermittent control circuit for carrying out control of the thyristors 2, and which is adapted to be connected to either an automatic control circuit 4 or manual actuators 5 via a switch 3. Reference symbol $C_1$ designates a capacitor, symbols $D_1$, $D_2$, $D_3$ and $D_4$ designate diodes, symbols $R_1$, $R_2$, $R_3$ and $R_4$ designate variable resistors, symbols $R_5$, $R_6$, and $R_7$ designate fixed resistors, symbol $TR_1$ designates a transistor, and symbols $IV_1$ and $IV_2$ designate CMOS IC inverters having an input-output characteristic as shown in FIG. 4.

In such a circuit arrangement, a voltage $V_A$ at a point A can have its pulse width $T_1$ and its pulse interval $T_2$ between one pulse and the next succeeding pulse freely preset by adjusting the variable resistors $R_1$ and $R_2$, respectively, and also can have its pulse height $A_1$ and pulse base level $A_2$ freely preset by adjusting the variable resistors $R_3$ and $R_4$, respectively.

A voltage at a point E is substantially equal to the voltage at the point A, the transistor $TR_1$ being interposed to operate as an emitter-follower for the purpose of current amplification and impedance transformation, and an output at a point G is an OR gate output for ORing the voltage levels at points E and F, so that the higher of the two is selectively output at the point G.

Figure 1:
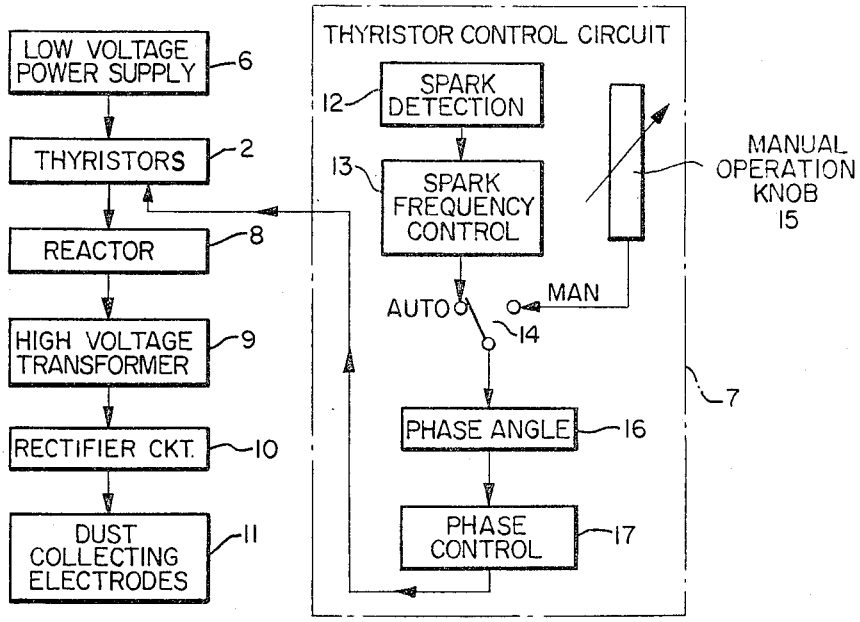
FIG. 1. (PRIOR ART)
FIG. 1 is a block diagram showing a circuit arrangement of a known electric dust collector.

To clarify FIGS. 2 and 3, in comparison to FIG. 1, it is noted that as an example, resistors R1–R4 may in fact be voltage controlled resistors or mechanically variable resistors which are mechanically connected to a servomotor drive and control system such that the four variable resistors may have their values controlled by a control voltage. As shown in FIG. 2, there are four manual actuators 5 for providing four voltage outputs used to control the resistance value of the four variable resistors R1–R4. In addition, there are four voltage outputs from the automatic circuit 4 which are alternatively used to control the resistance values of the four variable resistors R1–R4. The selector switch 3 in FIG. 2 essentially corresponds to the selector switch 14 in FIG. 1 but of course has four poles corresponding to the control signals for the four variable resistors R1–R4.

Furthermore, the output point G of FIG. 3 corresponds to the output of the intermittent control circuit 1 of FIG. 2.

With reference to FIG. 2, when the selector switch 3 is transferred to the manual position, the control for the power control device 2 is effected in a manual mode, and thus the variable resistors $R_1$, $R_2$, $R_3$ and $R_4$ as shown in FIG. 3 are manually adjusted to realize the desired pulse width $T_1$, pulse interval $T_2$, pulse height $A_1$ and base level $A_2$. On the other hand, when the selector switch 3 is transferred to the automatic control position, the control is effected in an automatic mode. Upon the automatic mode of control, for example, the following methods of control are possible:

(1) While the variable resistors $R_1$, $R_2$ and $R_4$ are fixed at constant values, the variable resistor $R_3$ (and thus the pulse height $A_1$) is automatically controlled by means of the heretofore known spark frequency or rate control circuit.

(2) The variable resistors $R_1$, $R_2$, $R_3$ and $R_4$ are controlled by a microcomputer according to a given algorithm. (The algorithm employed in this case could be, for example, to adjust the variable resistors $R_1$ to $R_4$ so as to optimize the product $V_P \times V_{AV}$ as will be explained later.)

Figure 6:
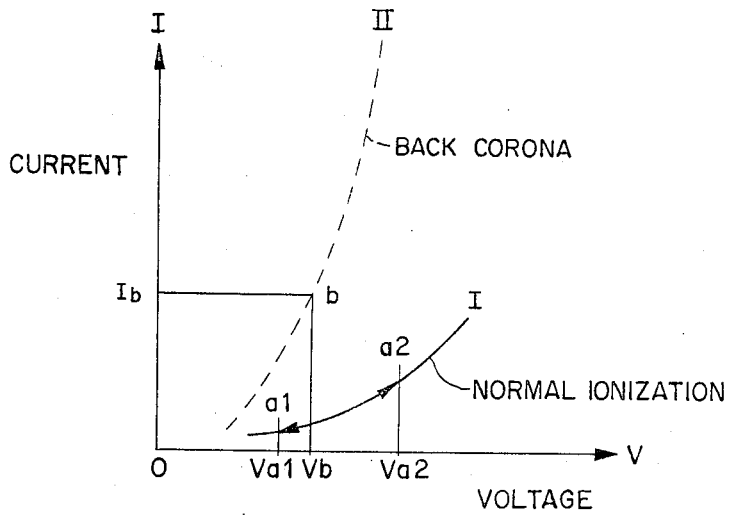
FIG. 6 is a voltage-current characteristic diagram showing the difference between normal ionization and back corona ionization in an electric dust collector.

Now describing the basic characteristics of the electric dust collecting effect, the voltage-current characteristic for normal ionization takes the mode represented by the curve I in FIG. 6, whereas upon occurrence of back corona ionization, the characteristic takes the mode represented by the curve II. If back corona ionization occurs, the voltage-current characteristics would vary along the curve II, so that the voltage would not substantially rise even if the current is increased, and hence, under such a condition, a wasteful current would flow.

The magnitude of the dust collecting efficiency is approximately proportional to a product $V_P \times V_{AV}$ of a peak value $V_P$ of the voltage and a time-average value $V_{AV}$ of the voltage, and therefore, the larger the product $V_P \times V_{AV}$ is, the higher is the dust collecting efficiency.

The back corona phenomena occurs when the time average of the current exceeds a certain value and at that time, the current-voltage characteristics change from the curve I to the curve II and this change occurs with a time delay of approximately one second.

Figure 7:
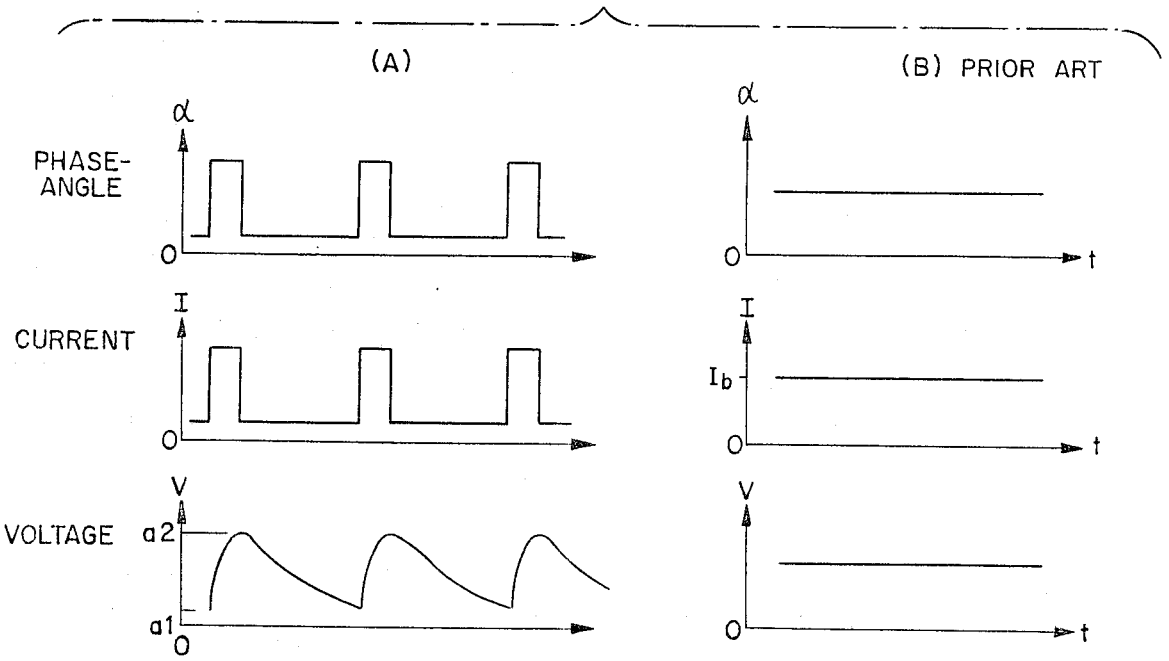
FIGS. 7(A) and 7(B) are respective waveforms of the control signal phase angle, the output current and the output voltage in an electric dust collector according to the present invention, and similar waveforms of the control signal phase angle, the output current and the output voltage in a known prior art electric dust collector.

In other words, even if the current I is abruptly increased and decreased between the current values $I_{a2}$ and $I_{a1}$ as shown by the middle waveform in FIG. 7 (A), the current-voltage characteristics still remain on the curve I in FIG. 6 when the time average value of the current is small. The time average value $I_{AV}$ of the current can be calculated by the equation of $$I_{AV} = I_{a2} \times \frac{T_1}{T_1 + T_2},$$

assuming that $I_{a1}=0$. In the prior art system, the time average value of the current is as large as $I_b$ as shown by the middle waveform in FIG. 7 (B) in order to make the voltage as large as possible, and hence, the current-voltage characteristic follows the curve II in FIG. 6.

Now comparing the values of $V_P \times V_{AV}$ between the prior art and the present invention with reference to FIG. 6, in the case of the dust collector of the prior art, the product $V_P \times V_{AV}$ is equal to $V_b^2$ because $V_P = V_b$ and $V_{AV} = V_b$ as will be seen from FIG. 6, whereas according to the present invention it becomes $V_{a2} \times V_{AV}$ because $V_P = V_{a2}$ in this case as will be seen from FIG. 6, and by appropriately selecting the parameters $T_1$, $T_2$, $A_1$ and $A_2$ it is possible to realize the condition of $V_b^2 < V_{a2} \times V_{AV}$.

The time average value $V_{AV}$ in the case of the present invention is not clear merely by reference to FIG. 6. The voltage waveform in practice takes the form shown by the bottom waveform in FIG. 7, and a time average value of this waveform is the average value $V_{AV}$. This average value exists between the maximum value $V_{a2}$ and the minimum value $V_{a1}$, it approaches successively to the minimum value $V_{a1}$ as the second period $T_2$ is increased. One example of operation data of the prior art system and the system according to the present invention is given in the following Table 1.

TABLE I

| | Prior Art System | System According To This Invention |
|---|---|---|
| $V_p$ | $28^{KV}$ | $44^{KV}$ |
| $V_{AV}$ | $27^{KV}$ | $22^{KV}$ |
| $V_P \times V_{AV}$ | 756 | 968 |

According to the results of many practical measurements, it has been reported that the dust collecting efficiency of the dust collector according to the present invention is increased by 10 to 20% or more as compared to that of the dust collector of the prior art.

Now the power consumption of the apparatus according to the present invention will be compared to that of the dust collector in the prior art, by way of example, with reference to the practical data given in Table 1 above. The power consumption is represented as an approximation by $V_{AV} \times I_{AV}$, where $V_{AV}$ represents a time average value of an applied voltage and $I_{AV}$ represents a time average value of a supplied current. The power consumption of the heretofore known dust collector was 27 KV ($V_{AV}$ in Table 1)$\times$1600 mA ($I_{AV}$)=43 KW. The power consumption in the case of the dust collector according to the present invention was reduced to 22 KV ($V_{AV}$ in Table 1)$\times$ 400 mA ($I_{AV}$)=8.8 KW. The numerical value 400 mA for the time average current $I_{AV}$ is calculated in the following manner. That is, assuming that $I_{a1}=0$ we obtain $$I_{AV} = I_{a2} \times \frac{T_1}{T_1 + T_2}.$$

Substituting the numerical values $I_{a2}=1600$ mA, $T_1=10_{ms}$ and $T_2=30_{ms}$ into this equation, the average value $$I_{AV} = 1600 \times \frac{10}{10+30} = 400 \text{ [mA]}$$

can be calculated. Thus, it can be appreciated that according to the present invention, an equally excellent dust collecting efficiency can be realized with a power consumption of only 20% of that of the prior art dust collector.

Finally, it should be noted that the intermittent charging type dust collecting apparatus according to the present invention is entirely different from the heretofore known pulse type dust collector. For the reader's reference, the distinctions between the above two types of dust collectors are enumerated in the following table:

| | Apparatus according to the present invention (intermittent charging) | Pulse type electric dust collector (in the prior art) |
|---|---|---|
| Repetition period | 0.01 – 1.0 s | 0.001 – 0.01 s |
| Charging pulse width | 1 – 1000 ms | 100 μs – 1 ms |
| Charging device | (1) Currently commercially available one, and (2) Electronic control circuit (heretofore used) with only minor modification. | (1) Currently commercially available one, (2) Control circuit (heretofore used), and (3) Separate pulse generator to be added newly. |
| Relative cost for comparison* | 100 + 20 ≈ 120 | 100 + 200 ≈ 300 |
| Saving of energy | Energy saved. | Not saved. |

*100 = cost of prior art D.C. high voltage supply.

In essence, according to the present invention, there is provided an energy-saving type dust collecting apparatus which can effectively collect dust particles having a specific resistance within the scope of $10^4$ to $10^{13}\Omega$cm, owing to the fact that in an electric dust collecting apparatus of the type that a dust collecting effect is achieved by applying between dust collecting electrodes a D.C. high voltage adapted to be controlled via a power control device including thyristors. A control circuit is provided for intermittently controlling the power control device in such manner that the repetition period and the pulse width may be adjusted manually or automatically so as to improve the dust collecting efficiency as mentioned above. Therefore, the present invention is industrially very useful.

Since many change could be made in the above construction and many apparently widely different embodiments of this invention could be made without departing the scope thereof, it is intended that all matter contained in the above description and shown in the accompanying drawings shall be interpreted as illustrative and not as a limitation to the scope of the invention.

What is claimed is:

1. An electric dust collecting apparatus having a low voltage power supply driving a high voltage transformer which drives a rectifier circuit which drives dust collecting electrodes and having a thyristor circuit operatively connected between said low voltage power supply and said high voltage transformer, said thyristor circuit being controlled by a thyristor control circuit operatively connected thereto, the improvement comprising:

an intermittent control circuit operatively connected between said thyristor control circuit and said thyristor circuit for transforming a D.C. voltage output from said thyristor control circuit into a periodic pulsed D.C. signal, said signal having a constant pulse width and a constant pulse repetition rate and having a constant maximum and a constant minimum voltage level;

and a means for adjusting at least one of said constant pulse width and pulse repetition rate and said constant minimum and maximum voltage levels of said periodic pulsed D.C. signal so as to prevent back corona from occurring in said dust collecting apparatus by periodically alternately supplying a high voltage and a reduced high voltage to said dust collecting electrodes.

2. An apparatus as in claim 1, wherein said constant pulse width is adjustable over a range of between 0.001 to 1.0 seconds.

3. An apparatus as in claim 1, wherein said constant repetition rate is adjustable over a range of between 0.01 to 1.0 seconds.

* * * * *